US006401813B1

(12) United States Patent
Carmichael et al.

(10) Patent No.: US 6,401,813 B1
(45) Date of Patent: Jun. 11, 2002

(54) WELLHEAD CLEANUP TOOL

(75) Inventors: Mark Carmichael, Jersey; Paul Howlett, Aberdeen, both of (GB)

(73) Assignee: SPS-AFOS Group Limited, Aberdeen (GB)

( * ) Notice: Subject to any disclaimer, the term of this patent is extended or adjusted under 35 U.S.C. 154(b) by 0 days.

(21) Appl. No.: 09/663,230

(22) Filed: Sep. 15, 2000

(30) Foreign Application Priority Data

Sep. 15, 1999 (GB) ..... 9921640

(51) Int. Cl.[7] ..... E21B 37/00
(52) U.S. Cl. ..... 166/173; 166/222; 166/312
(58) Field of Search ..... 166/311, 312, 166/170, 173, 177.7, 222; 175/424

(56) References Cited

U.S. PATENT DOCUMENTS 3,310,113 A * 3/1967 Maness ..... 166/170
4,612,986 A * 9/1986 Fosdick, Jr. et al. ..... 166/171
5,033,545 A 7/1991 Sudol
5,195,585 A 3/1993 Clemens et al.
6,289,987 B1 * 9/2001 Lay, Jr. ..... 166/169

FOREIGN PATENT DOCUMENTS

GB 2 256 887 A 12/1992
GB 2 323 871 A 10/1998
GB 2 324 818 A 11/1998

* cited by examiner

*Primary Examiner*—William Neuder
(74) *Attorney, Agent, or Firm*—Clifford E. Browning; Woodard, Emhardt, Naughton, Moriarty & McNett Patent and Trademark Attorneys

(57) ABSTRACT

A down-hole tool 1 has a body of varying cross-sectional diameter to correspond with a stepped profile of a well bore, such as at the well head. The tool is provided with cleaning members, such as bristles, and fluid circulation paths terminating in radial outlets 11 for cleaning otherwise difficult formations or profiles.

14 Claims, 8 Drawing Sheets

WELLHEAD CLEANUP TOOL

The present invention relates to borehole clean up, particularly a tool for cleaning up the stepped region of a wellhead.

Boreholes are typically lined with a concrete casing. In order to maximise production from the well it is necessary to clean out the casing, removing debris and contaminants.

One region of the borehole which is particularly hard to clean is the wellhead. The wellhead is stepped in diameter, with a larger diameter at the top. A typical profile is shown in FIG. 1. The diameters A, B, C and D are of commonly standardised dimensions, but there is some variation between steps E and F from well to well.

Due to the stepped profile, tools adapted to clean the main body of the borehole with brushes and jets of cleaning fluid will not be of the correct diameter to clean the upper steps. At the present time, the stepped profile of the wellhead cannot be properly cleaned.

Successfully cleaning the stepped region of the wellhead would significantly improve fluid flow in the region of the wellhead and so have benefits for production.

The primary aim of the present invention is to provide apparatus for cleaning stepped profile borehole casing.

A further aim of the present invention is to provide apparatus for cleaning stepped profile borehole casing that can adapt readily to the particular vertical distances between steps.

Running a workstring is time consuming and therefore expensive. For this reason, it is desirable to be able to run a workstring with tools to carry out a variety of functions. Therefore, a still further aim of the present invention is to provide apparatus for cleaning stepped profile borehole casing that can be integrated into a workstring and can also be employed only when required.

According to the present invention there is provided a cleanup tool for cleaning stepped regions of boreholes, the tool comprising a tool body into which fluid may flow axially, a plurality of radial outlets which correspond in position to the profile of a stepped region of a borehole and an engagable means for encouraging fluid to exit through the radial outlets.

Preferably, the tool body is adapted to be incorporated into a workstring.

The tool body may comprise a plurality of axially slidably mounted barrels adapted to rest on steps in the profile of a borehole and thereby to enable the position of the plurality of outlets to correspond to the profile of the stepped region of a borehole.

Springs may be provided to oppose the axial motion of the slidably mounted barrels.

The engagable means for encouraging fluid to exit through the radial outlets may comprise a valve activated by a ball dropped down the workstring.

Alternatively, the engagable means for encouraging fluid to exit through the radial outlets may comprise a valve that is engaged by the axial movement of a shear sleeve when the shear sleeve bottoms out on a step in a borehole.

Alternatively, the engagable means for encouraging fluid to exit through the radial outlets may comprise an outlet from which axially flowing fluid passes, a plug which acts to reduce fluid flow between the external surface of the tool and the internal surface of the borehole, and an inlet through which fluid may enter the body of the tool and subsequently exit through the radial outlets.

Preferably, the plug comprises a means for engaging a step in the internal surface of a borehole.

Preferably also, the means for engaging a step in the internal surface of a borehole comprises a curved profile.

Preferably also, the means for engaging a step in the internal surface of a borehole may be rotatably mounted on the tool body.

The present invention will now be described with reference to the following diagrams in which.

Figure 1:
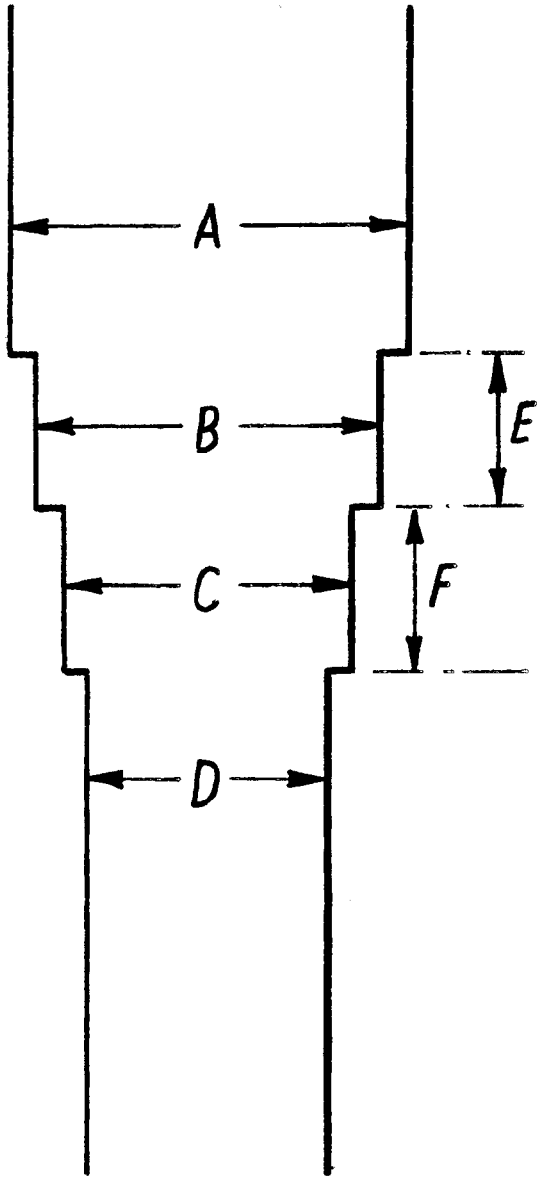
FIG. 1 shows a cross-section through a wellhead with a stepped internal casing.
Figure 2:
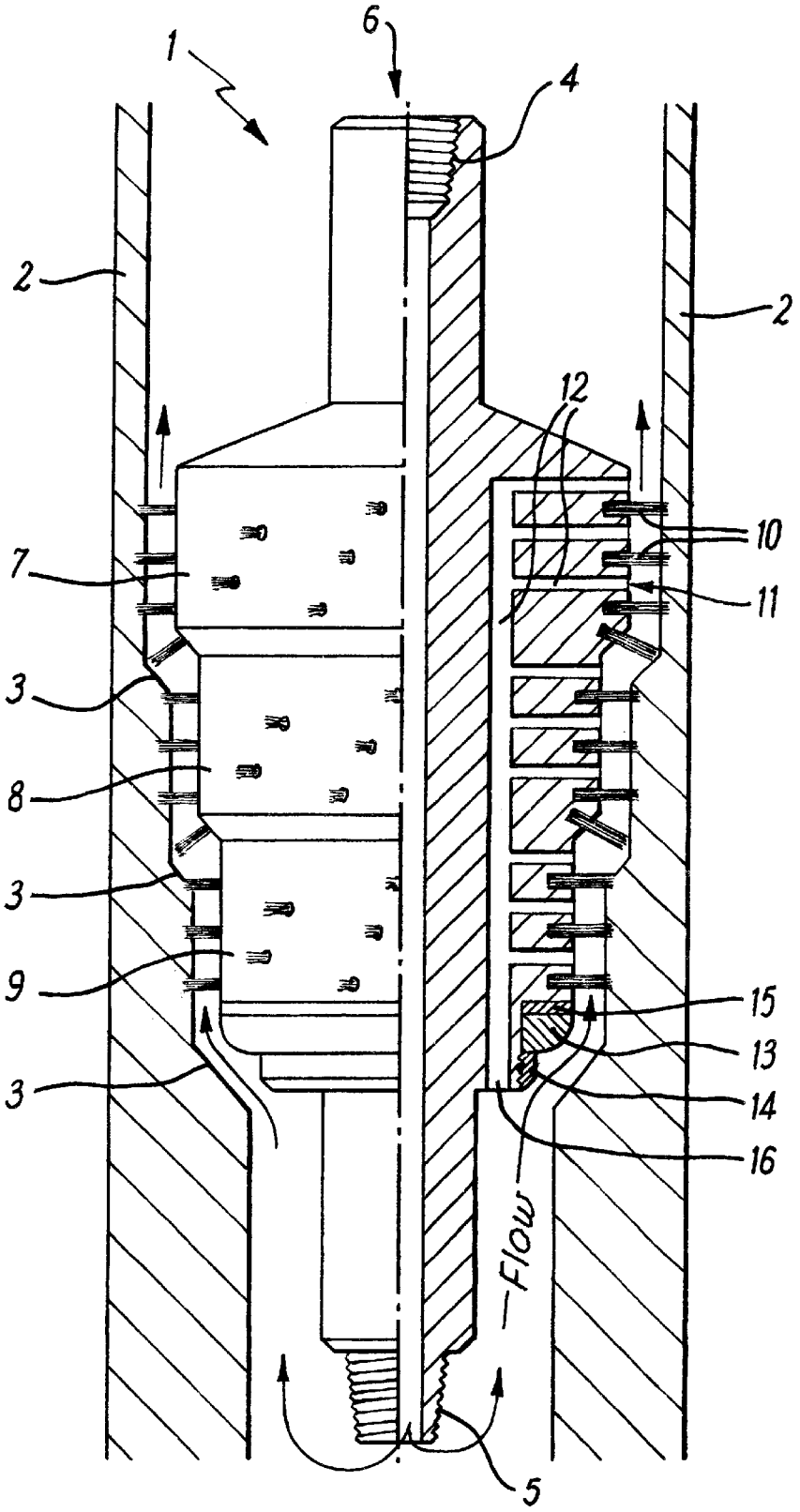
FIG. 2 shows a half-sectional elevation through a cleanup tool in a wellhead whilst the tool is not bottomed out.
Figure 3:
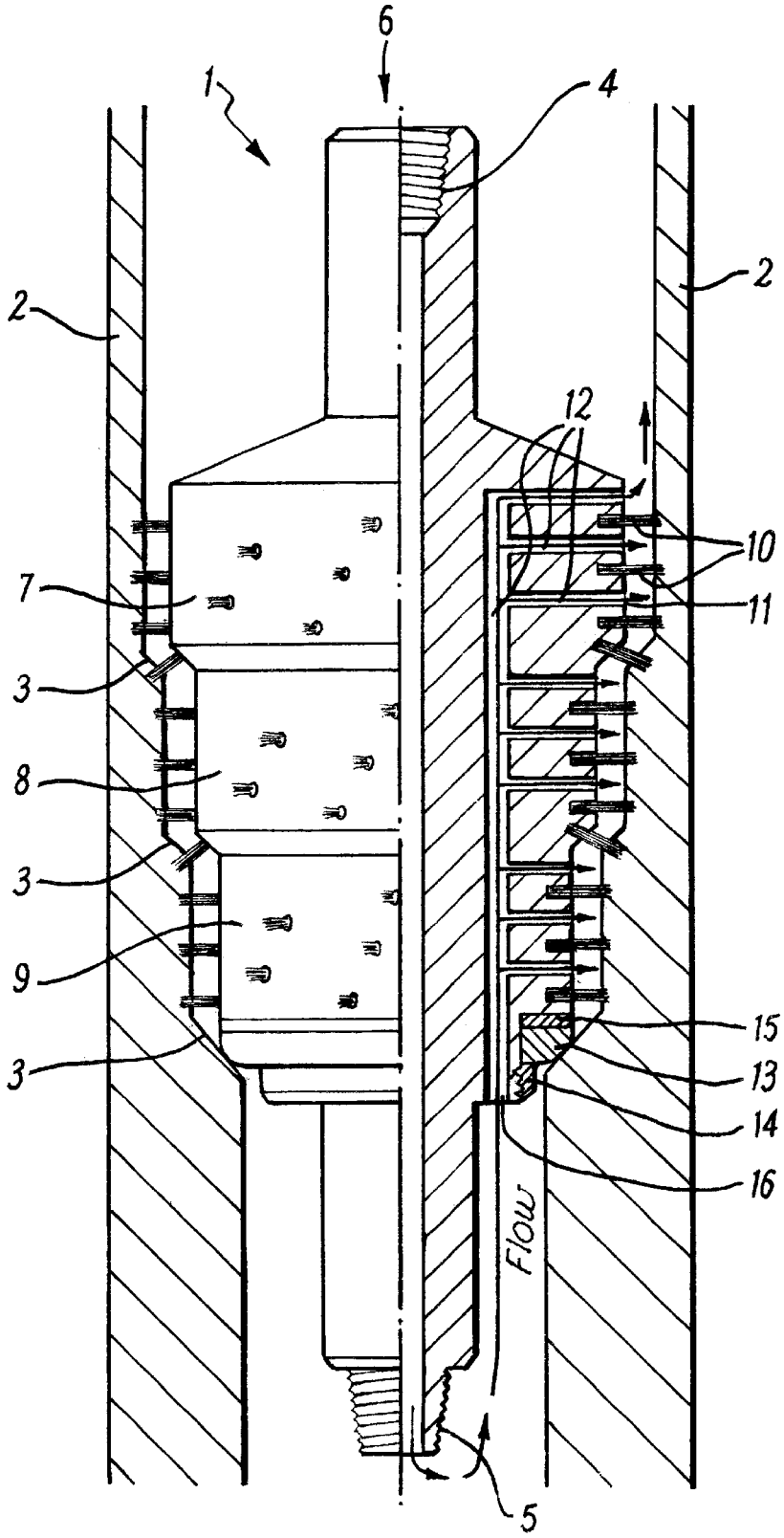
FIG. 3 shows a half-sectional elevation through a cleanup tool in a wellhead whilst the tool shoulder it bottomed out on a wellhead shoulder.

FIG. 2 shows in half-sectional elevation a cleanup tool 1 for use in a borehole wellhead 2 which has at least one step 3 in its diameter. FIG. 3 shows in half-sectional elevation the same cleanup tool bottomed out on a shoulder of the wellhead.

The cleanup tool is fixedly mounted in a workstring through upper and lower box connections 4, 5 and moves and rotates with the workstring.

Cleaning fluid is passed down the throughbore 6 of the workstring and cleanup tool. At or below the base of the cleanup tool, cleaning fluid is pumped out of the workstring into the central (cased) shaft or the borehole where it circulates upwards.

The body of the tool comprises in the present example three stepped outer cylindrical faces 7, 8, 9 designed to correspond to the stepped inner circumference of the wellhead, leaving only a small gap.

Two types of cleaning means are also provided. A plurality of brushes 10 brush debris from the wellhead. A plurality of radial outlets 11 also act to remove debris from the wellhead when cleaning fluid is forced through conduits 12.

In the configuration shown in FIG. 2, where the tool is not bottomed out on a shoulder of the wellhead, cleaning fluid returns to the surface through the annulus formed between the outside circumference of the cleanup tool and the inner circumference of the cleanup tool and the inner circumference of the wellhead. This annulus is stall relative to the cross-sectional area of the actual wellhead itself and so the cleaning fluid flows faster in the annulus than above or below the tool. The increased flow rate near the inner surface of the wellhead leads to efficient cleaning. Due to the correspondence between the stepped outer cylindrical faces and the internal circumference of the wellhead, the flow rate remains high throughout the stepped region and so the tool is efficient at cleaning stepped wellheads. The cleanup tool may be rotated by turning the workstring.

FIG. 3 shows the circumstance when the cleanup tool is lowered onto a shoulder of the wellhead. A main bearing ring 13 is provided which sits between a bearing retaining ring 14 and an upper bearing ring 15. The bearing retaining ring 14 has a curved profile and it is this curved profile which bottoms out on the step of the wellhead forming a partial seal. Due to the curved profile, a partial seal will be formed despite the variations which are found in practise between the diameters of the stepped internal circumference of different wellheads.

Due to the partial seal, pressure forces cleaning fluid through one or more ports 16 into conduits 12 thereby ejecting cleaning fluid out of the outlets 11 which also act to clean the internal circumference of the wellhead.

The seal may be partial or complete. The seal requires merely to ensure that much of the cleaning fluid passes through the ports and thereby out the radial outlets, although a better seal will improve the quality of the resulting cleaning.

It would be advantageous in practice to be able to rotate the workstring and cleanup tool in order to move the brushes and jets around the internal circumference of the wellhead and to operate other workstring functions. Clearly, this would be difficult if the curved profile which contacts the stepped wellhead were not mounted on bearings. Without this feature, friction would make it difficult to rotate the cleanup tool and the cleanup tool would readily be damaged.

It will be noted that the above invention, whilst highly effective in cleaning stepped wellheads which correspond in shape to the particular cleanup tool, would be less effective for cleaning wellheads which do not correspond in shape with the cleanup tool. As mentioned above, the diameters of steps are standardised but the distance between steps may vary between wells.

Figure 4:
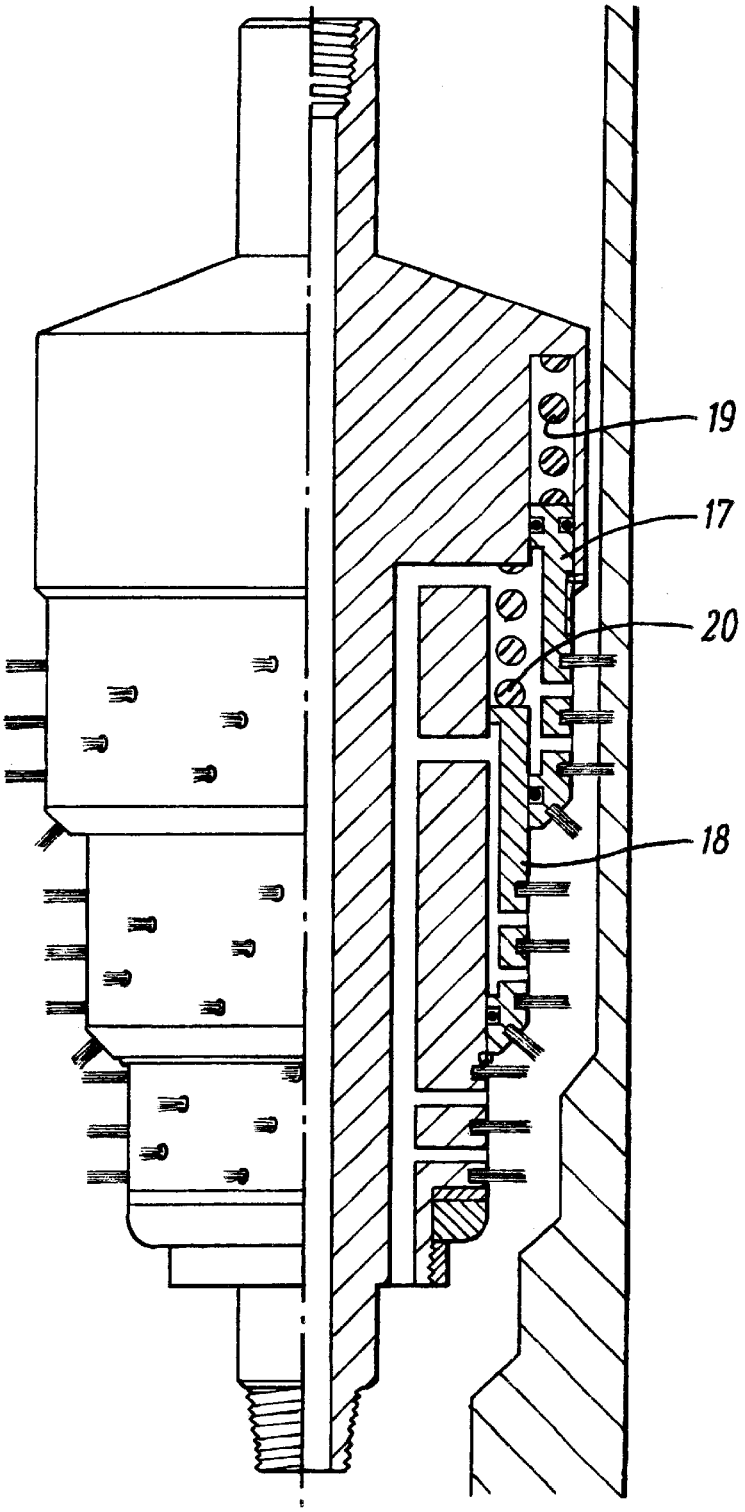
FIG. 4 shows a half-sectional elevation through a cleanup tool which can adapt to the particular spacing between steps in the given wellhead.

An alternative embodiment able to adapt to wellheads with different spacings between steps is show in half-sectional elevation in FIG. 4. Two barrels 17 and 18 are adapted to slide vertically. Each is keyed to prevent rotational movement. When the tool bottoms out on the stepped region of the wellhead, the slidable barrels 17, 18 are slid by the profile of the wellhead to the correct vertical height to clean the wellhead. Springs 19 and 20 act to push the barrels 17, 18 downward. Bearing rings may or may not be provided at the base of each barrel.

Figure 5:
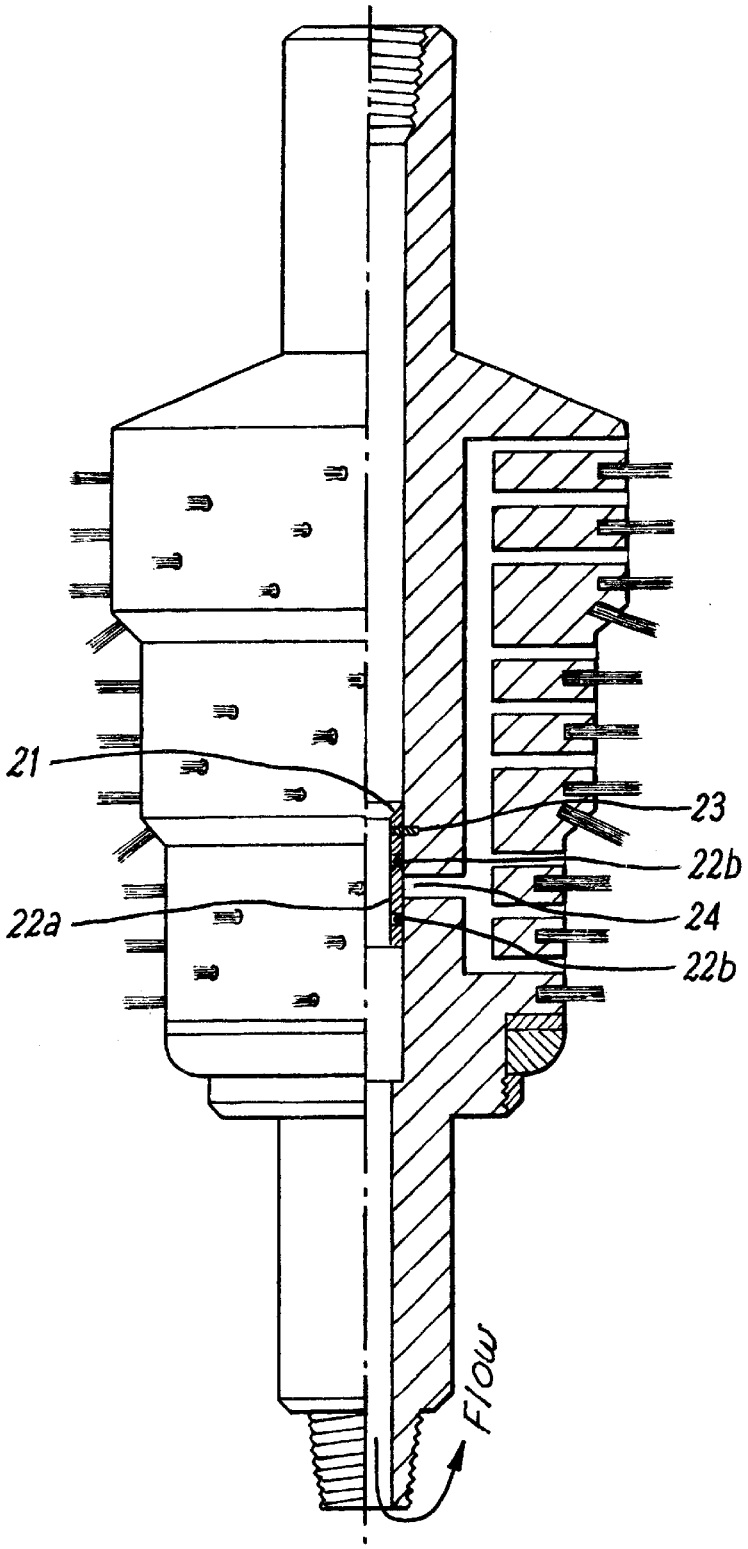
FIG. 5 shows a half-sectional elevation through an embodiment of a cleanup tool incorporating a ball seat before it is activated.

FIG. 5 illustrates in half-sectional elevation an alternative embodiment of a cleanup tool. This tool is provided with a ball seat 21 attached to a sleeve 22*a* on which are mounted seals 22*b* and a shear pin 23. The sleeve 22*a* initially blocks a port 24 and cleaning fluid forced down the throughbore passes out the base of the tool and flow upwards. However, a ball may be dropped down the throughbore to the ball seat 21, blocking flow of cleaning fluid. A buildup of pressure will then ensue until the pressure on the ball exceeds the capacity of the shear pin 123 which then shears, allowing the ball seat 21 and sleeve 22*a* to move down, opening access to the port 24.

Figure 6:
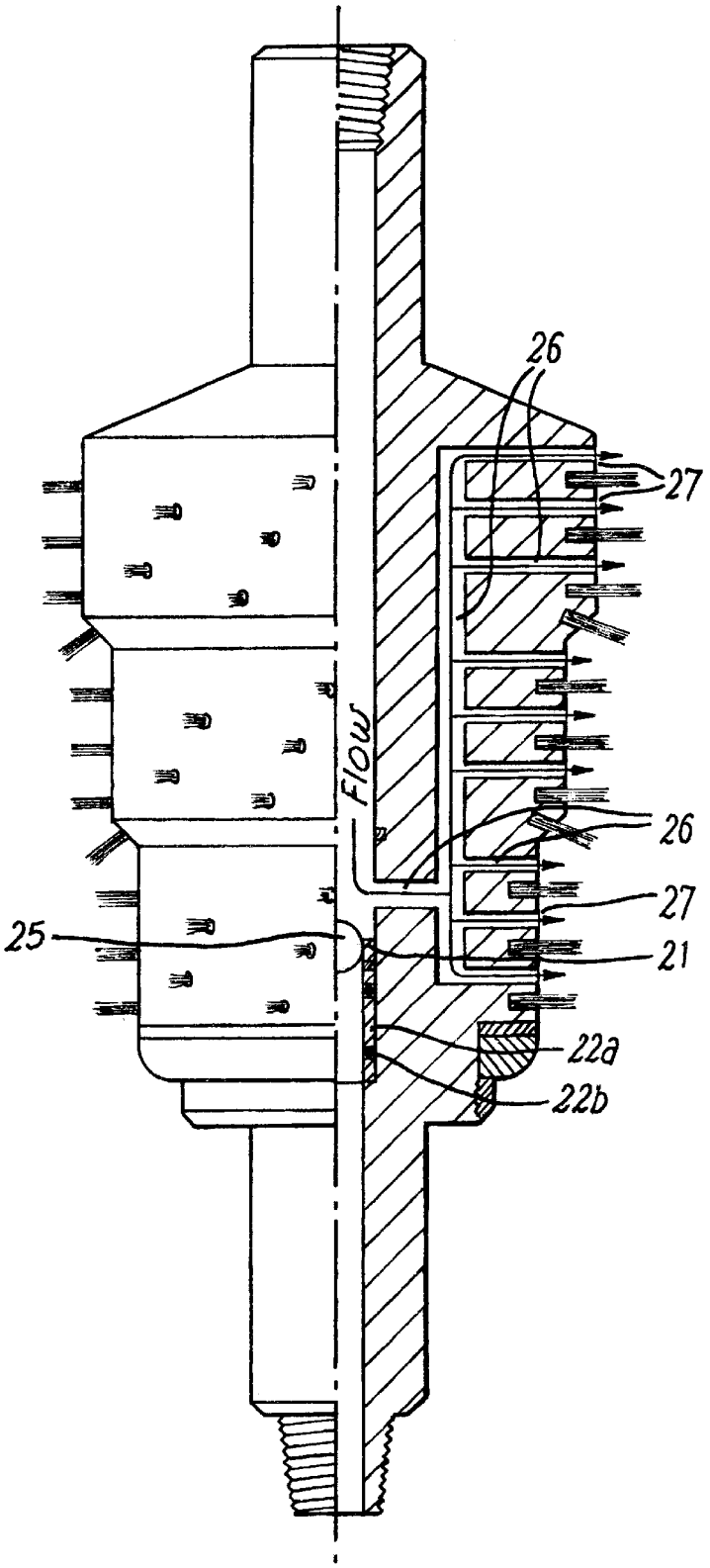
FIG. 6 shows a half-sectional elevation through an embodiment of a cleanup tool incorporating a ball seat after is have been activated.

FIG. 6 shows in half-sectional elevation the configuration once the pin has sheared and the port is opened. The ball 25 remains in the throughbore and so cleaning fluid follows a new flow path through the port into conduits 26 and out through outlets 27.

Figure 7:
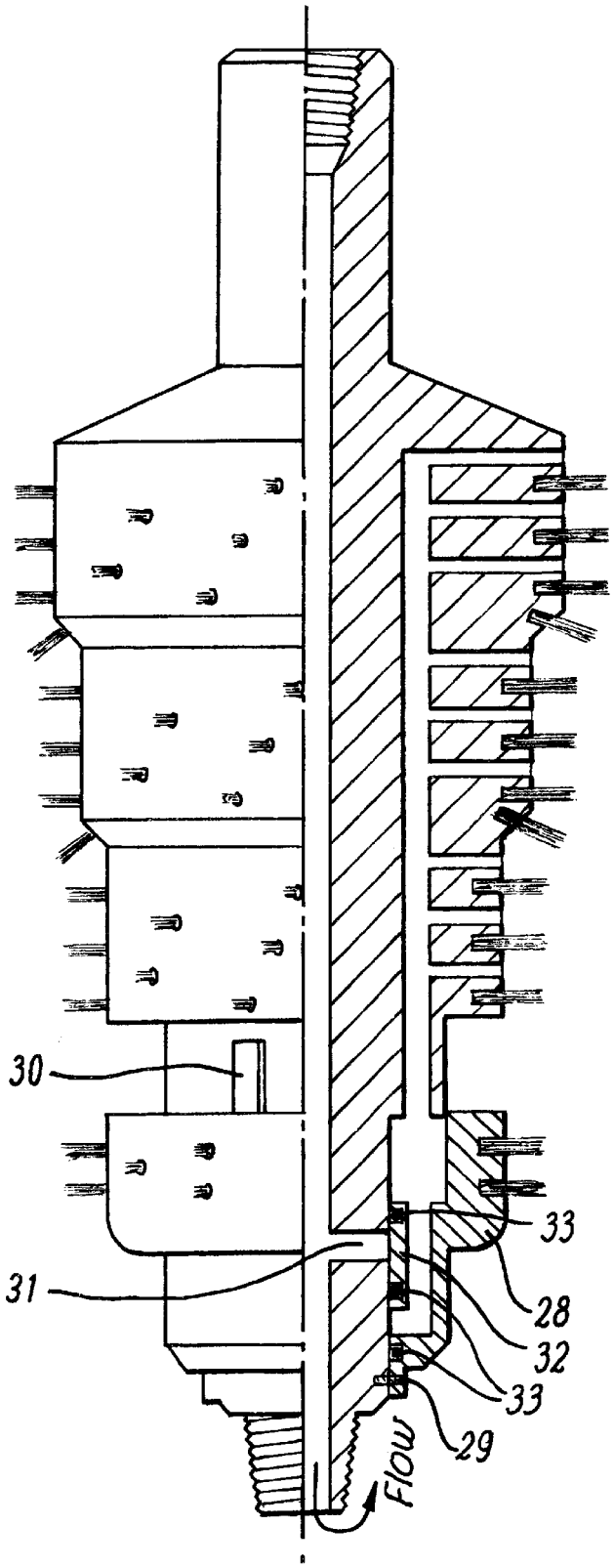
FIG. 7 shows a half-sectional elevation through an embodiment of a cleanup tool incorporating a shear sleeve before it is activated.

FIG. 7 shows in half-sectional elevation a further embodiment. In this embodiment there is provided a shear sleeve 28 which is prevented from moving vertically by a shear pin 29 and ins prevented from rotating relative to the mandrel by a key 30. As before, flow of cleaning fluid is initially axially through the tool. Fluid cannot reach the outlets as a port 31 is blocked by a section of the sleeve 32 bounded by seals 33.

Figure 8:
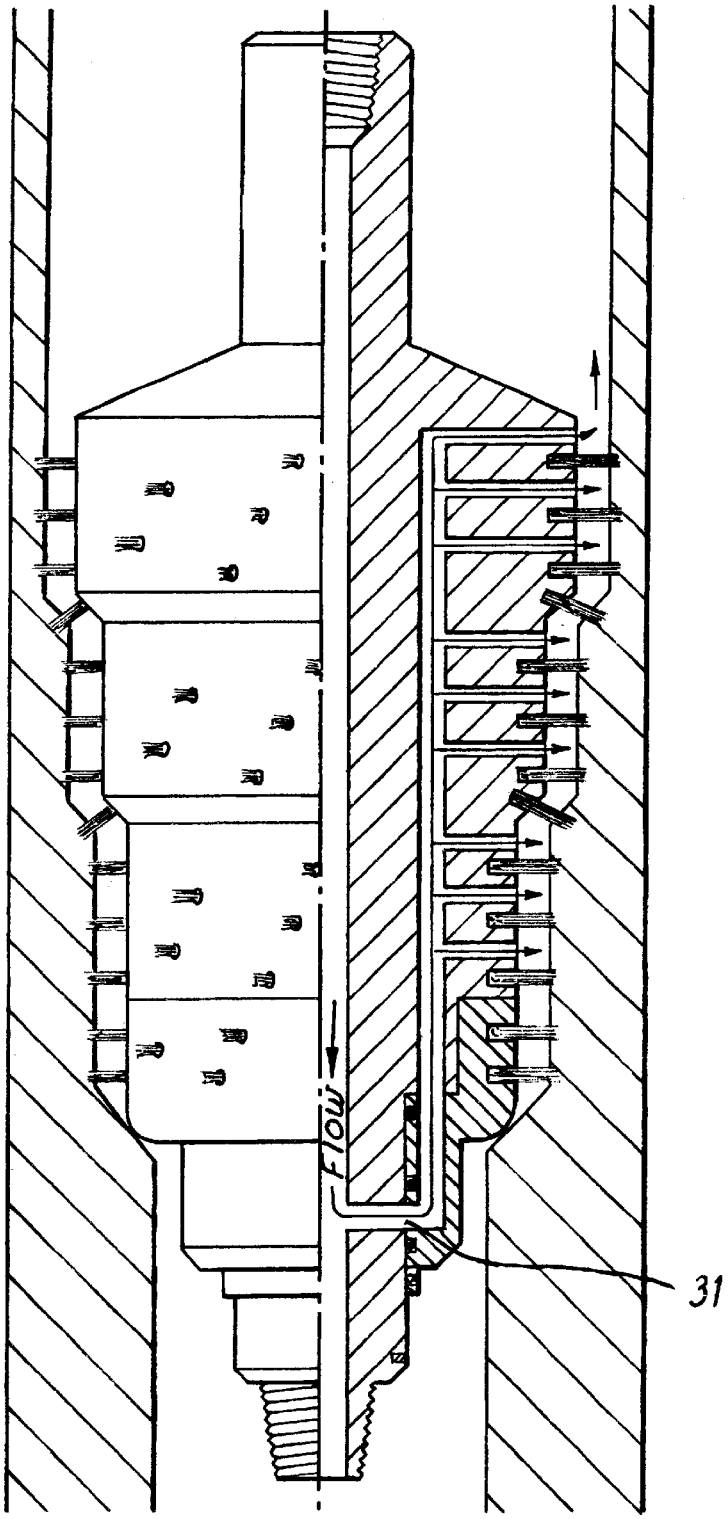
FIG. 8 shows a half-sectional elevation through an embodiment of a cleanup tool incorporating a shear sleeve after it has been activated.

In order to operate the jets, the tool is bottomed out on a shoulder of the wellhead. The resulting force shears the shear pin 29 and so the shear sleeve 28 is pushed up the body of the tool, opening the port 31. FIG. 8 shows in half-sectional elevation the resulting configuration in which cleaning fluid is now supplied to the outlets.

It will be clear to one skilled in the art that the various features described herein may readily be combined in different ways.

Further modifications and improvements may be incorporated without departing from the scope of the invention herein intended.

What is claimed is:

1. A cleanup tool suitable for cleaning regions of stepped or varying diameter in a well-bore, the tool comprising a tool body having an inlet for receiving fluid, wherein the inlet communicates with a passage defining a fluid path within said body, wherein the passage is associated with a first generally axial outlet and a plurality of radial outlets at least some of which are provided at varying radial distances from a central longitudinal axis, and an engageable means for selectively encouraging fluid in the tool body to exit through the radial outlets.

2. A cleanup tool as claimed in claim 1 wherein the tool body has a varying outer diameter which substantially corresponds to the profile of a region of stepped or varying diameter in a borehole.

3. A cleanup tool as claimed in claim 2 wherein the region in the borehole is the well head.

4. A cleanup tool as claimed in claim 1 wherein the tool body is adapted to be incorporated into a workstring.

5. A cleanup tool as claimed in claim 1 wherein the tool body comprises a plurality of cylindrical barrels that are axially slidable relative to a central part of the tool body, wherein the barrels are adapted to rest on steps in the profile of the wellbore wall or casing.

6. A cleanup tool as claimed in claim 5 wherein springs are provided to oppose the axial motion of the slidably mounted barrels.

7. A cleanup tool as claimed in claim 1 wherein the engagable means for encouraging fluid to exit through the radial outlets comprises a valve, wherein the valve is movable between a first position where the first outlet is open to a second position where the first outlet is closed.

8. A cleanup tool as claimed in claim 1 wherein the engagable means for encouraging fluid to exit through the radial outlets comprises a valve, wherein the valve is movable between a first position where the radial outlets are closed or obturated and a second position where the radial outlets are open and not obturated.

9. A clean up tool as claimed in claim 7 wherein the valve includes a dropped ball or dart.

10. A cleanup tool as claimed in claim 8 wherein, in use, movement of the valve from the first position to the second position is enabled by weight-setting the tool such that a shearable sleeve is sheared and moves to forcibly act on the valve.

11. A cleanup tool as claimed in claim 1 wherein the radial outlets are associated with a second inlet.

12. A cleanup tool as claimed in claim 1 wherein the tool body incorporates mechanical cleaning members.

13. A cleanup tool as claimed in claim 12 wherein the mechanical cleaning members are brush bristles.

14. A cleanup tool as claimed in claim 1 wherein the tool body comprises a bearing to facilitate rotation of the body relative to the stepped or varying diameter region of the borehole when the body is resting thereon.

* * * * *